US007451902B2

(12) United States Patent
Ohmura et al.

(10) Patent No.: US 7,451,902 B2
(45) Date of Patent: Nov. 18, 2008

(54) WEB TRANSPORTING MECHANISM OF PRINTING APPARATUS

(75) Inventors: Yuji Ohmura, Ibaraki (JP); Tsukasa Onose, Ibaraki (JP); Takeshi Terakado, Ibaraki (JP); Hidenori Iwanaga, Ibaraki (JP)

(73) Assignee: Ricoh Printing Systems, Ltd., Tokyo (JP)

( * ) Notice: Subject to any disclaimer, the term of this patent is extended or adjusted under 35 U.S.C. 154(b) by 514 days.

(21) Appl. No.: 11/044,050

(22) Filed: Jan. 28, 2005

(65) Prior Publication Data

US 2005/0184119 A1 Aug. 25, 2005

(30) Foreign Application Priority Data

Jan. 29, 2004 (JP) ..... P2004-021390

(51) Int. Cl.
*B65H 20/00* (2006.01)
*G03G 15/00* (2006.01)

(52) U.S. Cl. ..... 226/24; 226/34; 399/384

(58) Field of Classification Search ..... 226/24, 226/25, 34, 36, 111, 11; 399/284, 322, 384
See application file for complete search history.

(56) References Cited

U.S. PATENT DOCUMENTS 5,752,153 A * 5/1998 Kreiter et al. ..... 399/384
6,055,408 A * 4/2000 Creutzmann et al. ..... 399/384

FOREIGN PATENT DOCUMENTS

JP 9-146316 6/1997

* cited by examiner

*Primary Examiner*—Evan H Langdon
(74) *Attorney, Agent, or Firm*—McGinn IP Law Group, PLLC

(57) ABSTRACT

A web transporting mechanism of a printing apparatus has a buffer mechanism section for absorbing a fluctuation of the web length from a transporting section to a fixing section generated by a difference between a speed of transporting a web in the transporting section and a speed of transporting a web in the fixing section. The web transporting mechanism includes at least one brake member suppressing a motion of a movable buffer. The brake member has a drive means.

18 Claims, 2 Drawing Sheets

WEB TRANSPORTING MECHANISM OF PRINTING APPARATUS

BACKGROUND OF THE INVENTION

1. Field of the Invention

The present invention relates to a web transporting mechanism of a printing apparatus for forming an image on a web continuously transported. More particularly, relates to the web transporting mechanism of the printing apparatus having a buffer mechanism for absorbing a fluctuation of a web length between a transporting section and a fixing section.

2. Description of the Related Art

In a printing apparatus for forming an image on a continuous web, the web is transported in such a manner that a pin member of a tractor mechanism mounted on the printing apparatus is engaged in a sprocket hole of the web of paper and the web is transported when the tractor mechanism is driven. In the case where the web having the sprocket holes is used, it is necessary to cut off both end portions of the web, in which the sprocket holes are formed, after the completion of printing. Therefore, a printing apparatus has been put into practical use in which a web having no sprocket holes is used and the web is transported by a transporting roller mechanism instead of the tractor mechanism so that the work of cutting both end portions of the web can be avoided.

The above printing apparatus includes: a transporting section for recording and forming an image on a web; and a fixing section for fixing the image onto the web by heating and pressurizing toner which has been transported onto the web in the transporting section, wherein the web is discharged from the fixing section. However, in this structure, a transporting member (Hereinafter, referred to as transporting means,) for transporting the web in the transporting section and the transporting means for transporting the web in the fixing section are independently driven. Accordingly, it is difficult to perfectly make the web transporting speed in the transporting section coincide with the web transporting speed in the fixing section.

When the web transporting speed in the transporting section is higher than that in the fixing section, looseness of the web is caused between the transporting section and the fixing portion. When the web is continuously transported by the transporting section and the fixing section, the degree of looseness is increased. On the contrary, when the web transporting speed in the fixing section is higher than that in the transporting section, a sufficiently long web cannot be supplied from the transporting section to the fixing section. In order to solve the above problems, a buffer mechanism absorbs a fluctuation in the web length between the transporting section and the fixing section caused by a difference in the web transporting speed generated between the transporting section and the fixing section.

An example of the buffer mechanism of a conventional printing apparatus is shown in FIG. 3 and explained as follows.

There is provided a movable buffer 4, the position of which is changed according to the length (referred to as a web length L hereinafter) of the web 3 between the transporting section 1 and the fixing section 2. The movable buffer 4 is pushed to the web 3 by the twist coil spring 5, and a position of the movable buffer 4 is changed according to the web length L. The position of the movable buffer 4 is detected by the sensor 6. According to the detection signal, the web transporting speed in the fixing section 2 is controlled. Explanations will be made into a case in which the web transporting speed of the fixing section 2 is controlled by the rotating speed of the heat roller 7 and that of the pressure roller 8. In the case where it is detected that a position of the movable buffer 4 is higher than the target position (the wab length L is longer than the target value), the rotating speed of the heat roller 7 is increased so that the web length L can be shortened. On the contrary, in the case where it is detected that a position of the movable buffer 4 is lower than the target position (the wab length L is shorter than the target value), the rotating speed of the heat roller 7 is decreased so that the web length L can be extended. In this case, the explanations are made into the case in which the web transporting speed in the fixing section 2 is changed. However, it should be noted that the present invention is not limited to the above specific system. When a difference between the rotating speed of the web transporting rollers 9*a*, 9*b*, which determines the web transporting speed of the transporting section 1, and the rotating speed of the heat roller 7, which determines the web transporting speed in the fixing section 2, is made to be variable by the web transporting speed control circuit 10 according to the detection signal of the sensor 6 to detect the position of the movable buffer 4, the same effect can be provided. (See JP-A-9-146316.)

SUMMARY OF THE INVENTION

Due to the above constitution, even if the web transporting speed in the transporting section and the web transporting speed in the fixing section are not made to perfectly coincide with each other, it is possible to continuously transport the web at high speed.

In this case, in order to ensure the stability of continuously transporting the web, the spring constant of the twist coil spring for giving a reaction force to the movable buffer is set at a high value, so that a tension given to the web can be increased. However, when the spring constant of the twist coil spring is set at the high value, a transporting blurring is caused immediately after the start of transporting operation, and quality of printing is deteriorated as described as follows. That is, in the case where the timing of starting to transport the web in the fixing section is earlier than the timing of starting to transport the web in the transporting section, the web located in the buffer mechanism pushes down the movable buffer, and the movable buffer falls down by inertia. At this time, the web and the movable buffer are separated from each other, and a gap is formed between them. After that, the movable buffer is raised by a repulsion of the twist coil spring and comes into contact with the web again. At this time, the web slips on the web transporting roller by the shock generated at this time, and the web transporting speed fluctuates and transporting blurring is caused. On the contrary, in the case where the timing of starting to transport the web in the fixing section is later than the timing of starting to transport the web in the transporting section, the web sent out from the transporting section loosens on the buffer mechanism. At this time, the web and the movable buffer are separated from each other and a gap is formed between them. After that, the movable buffer is raised by the repulsion of the twist coil spring and comes into contact with the web again. At this time, the web slips on the web transporting roller by the shock generated at this time, and the web transporting speed fluctuates and transporting blurring is caused.

As described above, the following incompatible problems are caused, which will be explained in more detail as follows. When the spring constant of the twist coil spring is increased high so that the stability of continuously transporting the web can be enhanced, an intensity of the shock is increased at the time when the movable buffer comes into contact with the web immediately after the transporting operation has started.

Therefore, the transporting blurring is deteriorated, and the quality of printing is deteriorated immediately after the start of transporting the web. The printing speed of the printing apparatus has been recently increased. Accordingly, there is a stronger demand of stabilizing the operation of transporting the web. Therefore, it has become difficult to reduce a difference between the speed of transporting the web in the transporting section and the speed of transporting the web in the fixing section. As a result, a fluctuation of the web length between the transporting section and the fixing section is increased. Due to the foregoing, a remarkable phenomenon is caused in which the web located on the movable buffer is separated from the movable buffer immediately after the transporting operation has started. As a result, the degree of the transporting blurring is deteriorated by the shock caused when the movable buffer comes into contact with the web again, and the quality of printing is deteriorated immediately after the transporting operation has started. However, there is a strong demand of customers for higher quality these days. Therefore, it can be said that the importance of solving this problem is very high.

It is an object of the invention to enhance a quality of printing immediately after the operation of transporting a web has been started by reducing the transporting blurring by decreasing a shock at the time when the movable buffer comes into contact with the web immediately after the operation of transporting the web has been started without deteriorating the stability of continuously transporting the web.

In order to solve the above problems, there is provided with a web transporting mechanism of a printing apparatus including a movable buffer for absorbing a fluctuation of the web length from the transporting section to the fixing section which is generated by a difference between the speed of transporting the web in the transporting section and the speed of transporting the web in the fixing section, wherein at least one brake member for suppressing a motion of the movable buffer are provided and a drive means is provided in the brake member.

By thus configuration, a printing apparatus of high printing quality in which the quality of printing is enhanced immediately after the operation of transporting a web has been started by reducing the transporting blurring by decreasing a shock at the time when the movable buffer comes into contact with the web immediately after the operation of transporting the web has been started without deteriorating the stability of continuously transporting the web.

DESCRIPTION OF THE PREFERRED EMBODIMENTS

An object of suppressing a transporting blurring immediately after transporting a web has been started is realized without deteriorating the stability of continuously transporting the web.

Embodiment 1

Embodiment 1 of the buffer mechanism section of the present invention will be explained below referring to FIG. 1.

Figure 1:
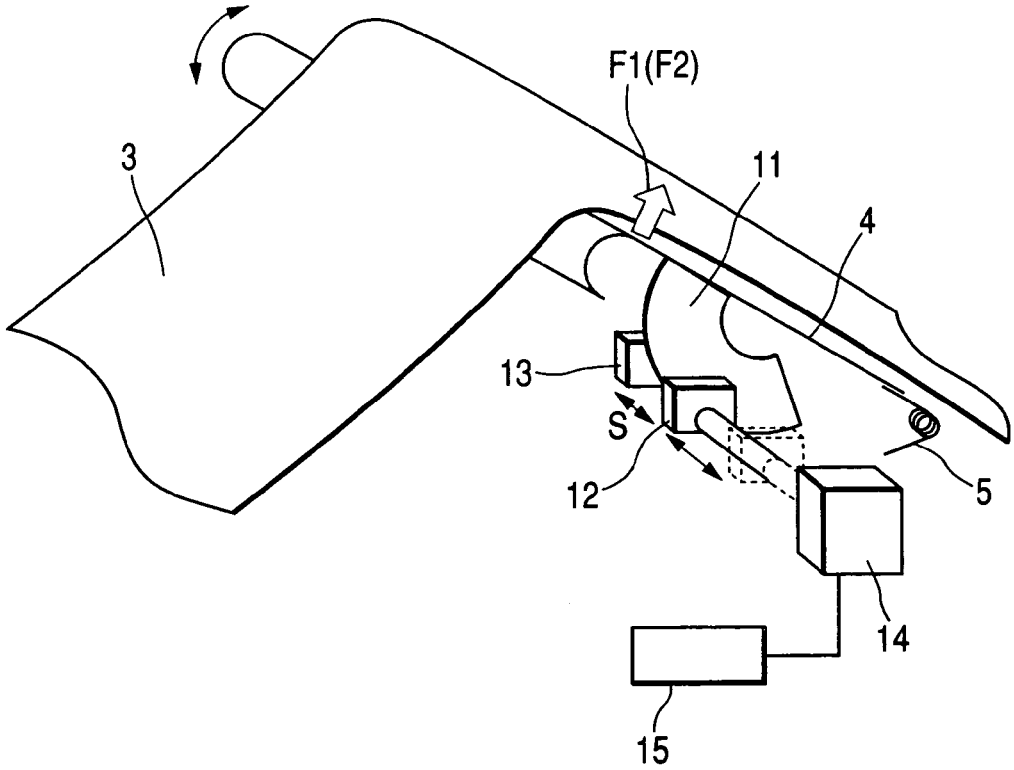
FIG. 1 is a perspective view showing the buffer mechanism section according to an embodiment of the invention.

In FIG. 1, reference numeral 3 is a web. In many cases, the web 3 is usually made of paper used for a printing apparatus. However, the web 3 is not necessarily limited to paper. In some cases, a plastic film is used as the web 3.

The brake plate 11 is provided in the movable buffer 4 located between the transporting section 1 and the fixing section 2. The support member 13 for supporting a pushing force of the brake member 12 is arranged at a position opposed to the brake member 12 while the brake plate 11 is being interposed between the brake member 12 and the support member 13. Due to this structure, the brake plate 11 is given a frictional force. Therefore, the original reaction force F1 given to the movable buffer 4 by the twist coil spring 5 is canceled by the frictional load, so that the reaction force F1 can be reduced. The brake member 12 is arranged so that it can be made to be variable between the position, at which the brake member 12 is contacted with the brake plate 11 by a drive member 14 (referred to as a drive means 14), and the position at which the brake member 12 is separated from the brake plate 11. In this embodiment, the drive means 14 is a solenoid by which a position of the brake member 12 can be linearly changed. Due to this structure, the reaction force of the movable buffer 4 can be changed between the original reaction force F1 and the reaction force F2 (F1>F2) which is a reaction force in the case where the brake member 12 is pushed to the brake plate 11.

The frictional load given to the brake plate 11 by the brake member 12 and the support member 13 depends upon a pushing force generated by the drive means 14. This pushing force can be adjusted when the interval S between the brake member 12 and the support member 13 is changed. That is, when the interval S is extended, the pushing force (frictional load) is reduced. As a result, the reaction force F2 is increased. On the contrary, when the interval S is reduced, the pushing force (frictional load) is increased. As a result, the reaction force F2 is decreased. In this way, when the interval S is changed, the reaction force F2 can be set at an arbitrary value from 0 to F1 ($0 \leqq F2 \leqq F1$).

The drive means 14 can drive the brake member 12 by a control signal sent from the drive means control circuit 15 according to the state of transporting the web. That is, before the transporting of the web is started, the brake member 12 and the support member 13 are pushed to the brake plate 11. Immediately after the start of transporting the web, in order to reduce a shock given from the movable buffer to the web 3, the reaction force of the movable buffer 4 is made to be the reaction force F2 so as to suppress the transporting blurring. In this way, the printing quality can be enhanced. After that, the brake member 12 is retracted by the drive means 14 to a position separate from the brake plate 11 so that the reaction force of the movable buffer 4 can be made to be the original reaction force F1 generated by the coil spring 5. In this way, the stability of continuously transporting the web can be ensured. The drive timing of the drive means 14, that is, the timing at which the reaction force of the movable buffer 4 is changed over from F2 to F1 (or from F1 to F2) is determined while consideration is being given to the transporting blurring and the stability of transporting the web. Therefore, the timing at which the reaction force of the movable buffer 4 is changed over from F2 to F1 (or from F1 to F2) is determined by making experiments. Even in the structure in which the support member 13 is not provided, as long as it is a system in which the brake member 12 is pushed to the brake plate 11 so as to give a brake force and suppress a motion of the movable buffer 4, the same setting can be made.

Embodiment 2

Figure 2:
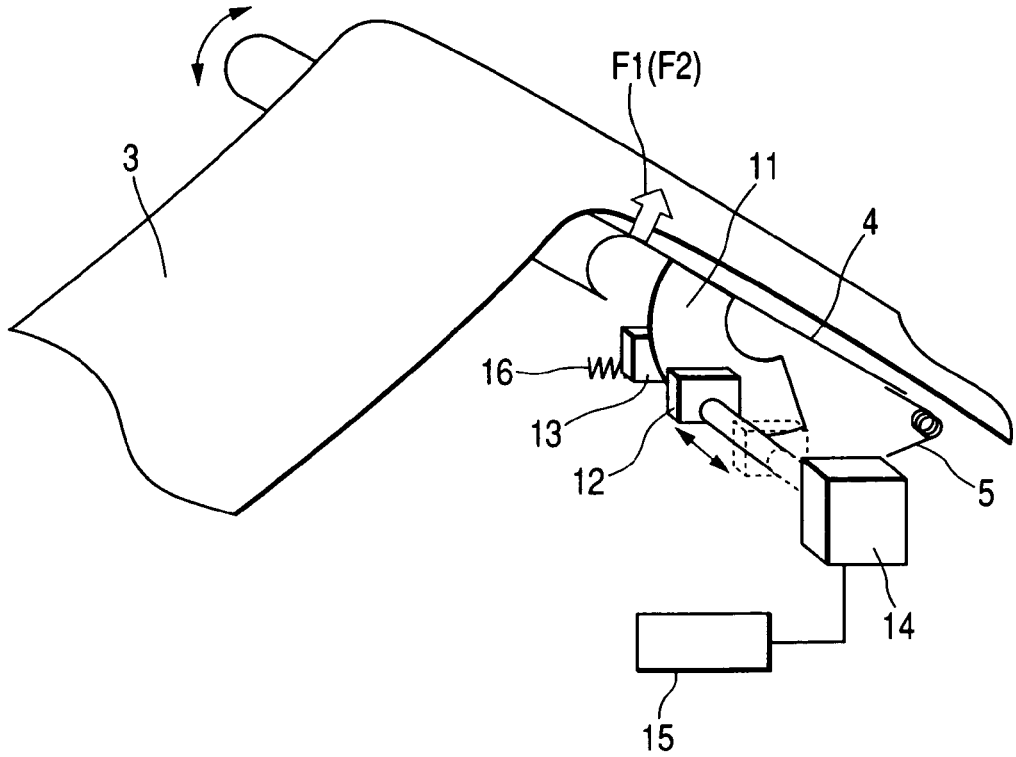
FIG. 2 is a perspective view showing the buffer mechanism section of the embodiment of the invention.
Figure 3:
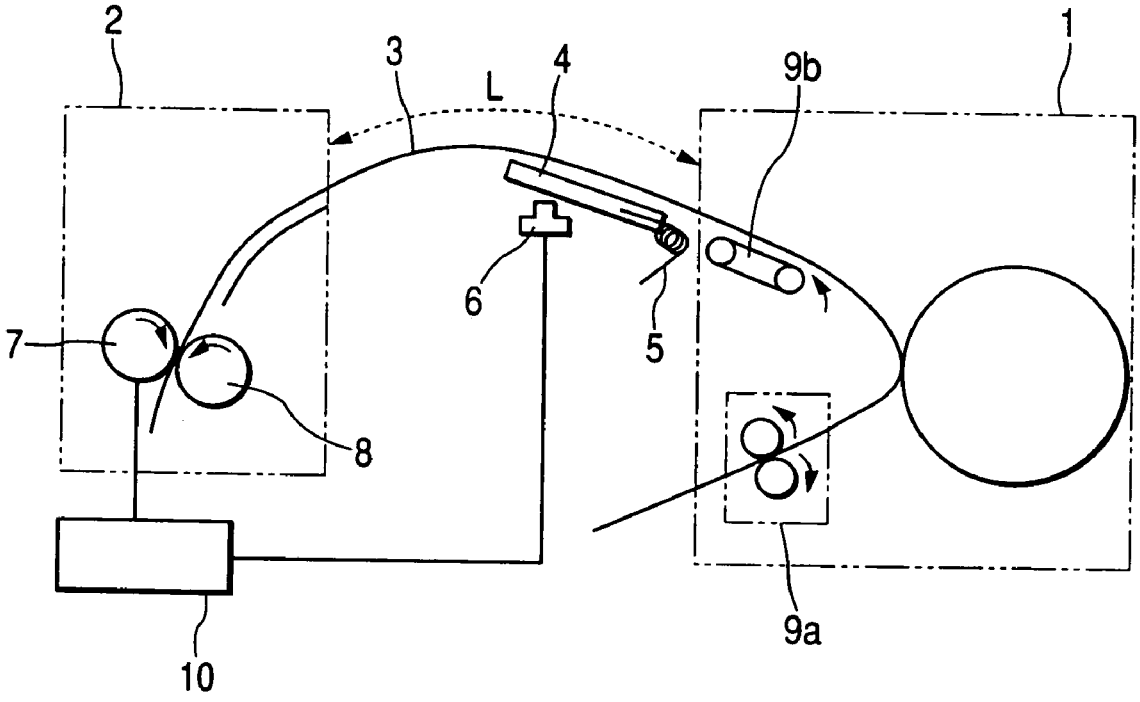
Prior Art FIG. 3
FIG. 3 is an arrangement view showing an outline of the related art.

Embodiment 2 is shown in FIG. 2. In this embodiment, the spring 16 is arranged at the rear of the support member 13 of Embodiment 1. In the case of the brake mechanism of the present invention, as the brake mechanism is frequently used, the contact faces of the brake plate 11, the brake member 12 and the support member 13 are abraded and the pushing force (frictional load) is decreased. Accordingly, there is a possibility that the reaction force F2 of the movable buffer immediately after the start of transporting the web is changed with time. However, when the pushing force is further given by the spring 16 and the spring constant of the spring 16 is set at a value as low as possible, it is possible to reduce a change in the pushing force (frictional load) relying on the pushing stroke which has changed by the abrasion of the contact faces described above. In this embodiment, the spring 16 is arranged on the support member 13 side. However, the spring 16 may be attached to the brake member 12 side. Alternatively, the spring 16 may be attached to the brake plate 11 side.

What is claimed is:

1. A web transporting mechanism of a printing apparatus for forming an image on a web to be transported comprising:

a transporting section for forming the image on the web;

web transporting means for transporting the web from the transporting section;

a web discharging mechanism located in a rear portion of the transporting section, for discharging the web on which the image is transported in the transporting section; and a buffer mechanism giving a tension to the web, and absorbing a fluctuation of a web length from the transporting section to the web discharging mechanism generated by a difference between a web transporting speed of the transporting section and a web transporting speed of the web discharging mechanism, wherein the buffer mechanism includes a movable buffer, a position of which is changed according to the web length, wherein the web transporting mechanism includes at least one brake member, located in the buffer mechanism, for suppressing a motion of the movable buffer, and wherein drive means is provided in the brake member, wherein, before a transporting of the web is started, the brake member suppresses the motion of the movable buffer to reduce a shock generated immediately after a start of said transporting, and wherein a suppression of the movable buffer by the brake member is released after said transporting is started.

2. The web transporting mechanism of a printing apparatus according to claim 1, wherein a brake force of the brake member is adjustable according to a state of transporting the web.

3. The web transporting mechanism of a printing apparatus according to claim 1, wherein the brake member is pushed to the movable buffer via a spring.

4. The web transporting mechanism of a printing apparatus according to claim 2, wherein the brake member is pushed to the movable buffer via a spring.

5. The web transporting mechanism of a printing apparatus according to claim 1, wherein the web transporting means comprises friction drive rollers.

6. The web transporting mechanism of a printing apparatus according to claim 1, wherein the web passes through friction drive rollers in the transporting section.

7. The web transporting mechanism of a printing apparatus according to claim 1, wherein a spring pushes the movable buffer to the web.

8. The web transporting mechanism of a printing apparatus according to claim 1, wherein the movable buffer further comprises a support member for supporting a pushing force of the brake member, and wherein the support member is arranged at a position opposed to the brake member.

9. The web transporting mechanism of a printing apparatus according to claim 8, wherein a brake plate is placed between the brake member and the support member.

10. The web transporting mechanism of a printing apparatus according to claim 9, wherein the brake member contacts the brake plate by the drive means.

11. The web transporting mechanism of a printing apparatus according to claim 1, wherein the drive means comprises a solenoid by which a position of the brake member is linearly changeable.

12. The web transporting mechanism of a printing apparatus according to claim 1, wherein a control signal from the drive means drives the brake member according to a state of transporting the web.

13. The web transporting mechanism of a printing apparatus according to claim 3, wherein the spring is attached to the brake member.

14. The web transporting mechanism of a printing apparatus according to claim 8, wherein the brake member is pushed to the movable buffer via a spring.

15. The web transporting mechanism of a printing apparatus according to claim 14, wherein the spring is attached to the support member.

16. A web transporting mechanism of a printing apparatus for forming an image on a web to be transported, comprising:

a transporting section for forming the image on the web;

at least a pair of friction drive rollers for transporting the web from the transporting section, wherein the web passes through the friction drive rollers in the transporting section;

a web discharging mechanism located in a rear portion of the transporting section, for discharging the web on which the image is transported in the transporting section; and a buffer mechanism giving a tension to the web, and absorbing a fluctuation of a web length from the transporting section to the web discharging mechanism, wherein the buffer mechanism includes a movable buffer, a position of which is changed according to the web length, wherein the web transporting mechanism includes at least one brake member, located in the buffer mechanism, for suppressing a motion of the movable buffer, and wherein a drive member is provided in the brake member, wherein, before a transporting of the web is started, the brake member suppresses the motion of the movable buffer to reduce a shock generated immediately after a start of said transporting, and wherein a suppression of the movable buffer by the brake member is released after said transporting is started.

17. The web transporting mechanism of a printing apparatus according to claim 16, wherein the movable buffer further comprises a support member for supporting a pushing force of the brake member, and wherein the support member is arranged at a position opposed to the brake member.

18. The web transporting mechanism of a printing apparatus according to claim 17, wherein a brake plate is placed between the brake member and the support member.

* * * * *

UNITED STATES PATENT AND TRADEMARK OFFICE

CERTIFICATE OF CORRECTION

PATENT NO. : 7,451,902 B2
APPLICATION NO. : 11/044050
DATED : November 18, 2008
INVENTOR(S) : Yuji Ohmura et al.

It is certified that error appears in the above-identified patent and that said Letters Patent is hereby corrected as shown below:

On the Title Page,

In line (30) change the Foreign Application Priority Data as follows:

January 30, 2004 (JP) P2004-023212

Signed and Sealed this

Twenty-fourth Day of February, 2009

JOHN DOLL
*Acting Director of the United States Patent and Trademark Office*